US009989320B2

(12) United States Patent
Lech et al.

(10) Patent No.: US 9,989,320 B2
(45) Date of Patent: Jun. 5, 2018

(54) TUBE AND BAFFLE ARRANGEMENT IN A ONCE-THROUGH HORIZONTAL EVAPORATOR

(71) Applicant: Alstom Technology Ltd., Baden (CH)

(72) Inventors: Christopher J. Lech, Feeding Hills, MA (US); William D. Kupernik, Windsor Locks, CT (US); Paul J. Chapman, Windsor, CT (US); James D. Pschirer, Enfield, CT (US); Jeffrey F. Magee, Longmeadow, MA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 265 days.

(21) Appl. No.: 13/744,126

(22) Filed: Jan. 17, 2013

(65) Prior Publication Data

US 2013/0192810 A1 Aug. 1, 2013

Related U.S. Application Data

(60) Provisional application No. 61/587,332, filed on Jan. 17, 2012, provisional application No. 61/587,230,
(Continued)

(51) Int. Cl.
*F28D 7/00* (2006.01)
*F28F 9/02* (2006.01)
(Continued)

(52) U.S. Cl.
CPC ..... *F28F 9/02* (2013.01); *F16B 17/00* (2013.01); *F22B 29/06* (2013.01); *F28D 7/082* (2013.01);
(Continued)

(58) Field of Classification Search
CPC ..... F22B 29/06; F28D 7/087; F28D 7/085; F28F 9/0132
(Continued)

(56) References Cited

U.S. PATENT DOCUMENTS 343,258 A 6/1886 Smith
459,998 A 9/1891 Davis
(Continued)

FOREIGN PATENT DOCUMENTS

CH 144501 A 12/1930
CN 2420739 Y 2/2001
(Continued)

OTHER PUBLICATIONS

Korean Notice of Preliminary Rejection dated Jan. 23, 2015 for Korean Patent Appln. No. 10-2013-7021477.
(Continued)

*Primary Examiner* — Justin Jonaitis
*Assistant Examiner* — Eric Ruppert
(74) *Attorney, Agent, or Firm* — GE Global Patent Operation; Stephen G. Midgley

(57) ABSTRACT

Disclosed herein is a once-through evaporator comprising an inlet manifold; one or more inlet headers in fluid communication with the inlet manifold; one or more tube stacks, where each tube stack comprises one or more inclined evaporator tubes; the one or more tube stacks being in fluid communication with the one or more inlet headers; where the inclined tubes are inclined at an angle of less than 90 degrees or greater than 90 degrees to a vertical; one or more outlet headers in fluid communication with one or more tube stacks; and an outlet manifold in fluid communication with the one or more outlet headers; and a baffle system com-
(Continued)

prising a plurality of baffles; the baffle system being disposed adjacent to a tube stack so that the baffle system contacts a tube.

12 Claims, 11 Drawing Sheets

Related U.S. Application Data filed on Jan. 17, 2012, provisional application No. 61/587,428, filed on Jan. 17, 2012, provisional application No. 61/587,359, filed on Jan. 17, 2012, provisional application No. 61/587,402, filed on Jan. 17, 2012.

(51) Int. Cl.

| | |
|---|---|
| ***F28F 1/00*** | (2006.01) |
| ***F16B 17/00*** | (2006.01) |
| ***F22B 29/06*** | (2006.01) |
| ***F28F 9/013*** | (2006.01) |
| ***F28F 9/26*** | (2006.01) |
| ***F28D 7/08*** | (2006.01) |
| *F22B 37/00* | (2006.01) |

(52) U.S. Cl.
CPC ..... *F28F 1/00* (2013.01); *F28F 9/0131* (2013.01); *F28F 9/26* (2013.01); *F22B 37/001* (2013.01); *Y10T 29/4935* (2015.01); *Y10T 403/70* (2015.01); *Y10T 403/7075* (2015.01)

(58) Field of Classification Search
USPC ..... 165/67, 144, 145, 173, 175, 178
See application file for complete search history.

(56) References Cited

U.S. PATENT DOCUMENTS

| | | | | |
|---|---|---|---|---|
| 505,735 | A | | 9/1893 | Vanes |
| 1,256,220 | A | * | 2/1918 | Fulton ..... B60H 1/00464 165/99 |
| 1,521,864 | A | * | 1/1925 | Broido ..... 165/181 |
| 1,569,050 | A | * | 1/1926 | Swartz, Jr. ..... 248/234 |
| 1,764,981 | A | * | 6/1930 | Rehfuss ..... F22B 21/007 122/235.15 |
| 1,814,447 | A | | 7/1931 | Jones |
| 1,827,946 | A | | 10/1931 | Mayr |
| 1,884,778 | A | | 10/1932 | Lucke et al. |
| 1,895,220 | A | | 1/1933 | Grebe |
| 1,924,850 | A | | 8/1933 | Freiday |
| 1,965,427 | A | | 7/1934 | Nerad |
| 2,800,887 | A | | 7/1957 | Profos |
| 2,847,192 | A | * | 8/1958 | Smith et al. ..... 165/159 |
| 3,004,529 | A | | 10/1961 | Argersinger et al. |
| 3,368,534 | A | | 2/1968 | Gorzegno et al. |
| 3,447,602 | A | | 6/1969 | Dalin |
| 3,789,806 | A | | 2/1974 | Gorzegno |
| 3,854,455 | A | | 12/1974 | Carson et al. |
| 3,896,874 | A | * | 7/1975 | Bongaards et al. ..... 165/82 |
| 4,246,872 | A | * | 1/1981 | Skinner et al. ..... 122/510 |
| 4,290,389 | A | | 9/1981 | Palchik |
| 4,331,105 | A | | 5/1982 | Kawamura et al. |
| 4,336,642 | A | | 6/1982 | Engelberts |
| 4,532,985 | A | | 8/1985 | Cutler |
| 4,638,857 | A | | 1/1987 | Fournier |
| 4,676,305 | A | | 6/1987 | Doty |
| 4,676,310 | A | | 6/1987 | Scherbatskoy et al. |
| 4,915,062 | A | | 4/1990 | Dolezal |
| 4,976,310 | A | | 12/1990 | Jabs |
| 5,097,819 | A | * | 3/1992 | Talbert et al. ..... 126/110 R |
| 5,265,129 | A | | 11/1993 | Brooks et al. |
| 5,293,842 | A | | 3/1994 | Loesel |
| 5,366,452 | A | | 11/1994 | Widlund et al. |
| 5,398,644 | A | | 3/1995 | Nilsson et al. |
| 5,412,936 | A | | 5/1995 | Lee et al. |
| 5,540,276 | A | | 7/1996 | Adams et al. |
| 5,628,183 | A | | 5/1997 | Rice |
| 6,019,070 | A | | 2/2000 | Duffy |
| 6,055,803 | A | | 5/2000 | Mastronarde |
| 6,062,017 | A | | 5/2000 | Liebig |
| 6,173,679 | B1 | | 1/2001 | Brueckner et al. |
| 6,189,491 | B1 | | 2/2001 | Wittchow et al. |
| 6,244,330 | B1 | * | 6/2001 | Eisinger et al. ..... 165/69 |
| 6,311,647 | B1 | | 11/2001 | Liebig et al. |
| 6,820,685 | B1 | | 11/2004 | Carter et al. |
| 6,868,807 | B2 | | 3/2005 | Franke et al. |
| 6,957,630 | B1 | | 10/2005 | Mastronarde |
| 7,017,529 | B1 | * | 3/2006 | Lomax et al. ..... 122/235.15 |
| 7,428,374 | B2 | | 9/2008 | Franke et al. |
| 7,770,544 | B2 | | 8/2010 | Viskup, Jr. |
| 7,886,538 | B2 | | 2/2011 | Schottler et al. |
| 7,963,097 | B2 | | 6/2011 | Mastronarde |
| 9,151,488 | B2 | | 10/2015 | Magee |
| 9,696,098 | B2 | | 7/2017 | Magee et al. |
| 9,746,174 | B2 | | 8/2017 | Wilhelm et al. |
| 2003/0051501 | A1 | | 3/2003 | Matsushina et al. |
| 2003/0164232 | A1 | | 9/2003 | Inoue et al. |
| 2004/0069244 | A1 | | 4/2004 | Schroeder |
| 2006/0075977 | A1 | | 4/2006 | Franke et al. |
| 2006/0078749 | A1 | | 4/2006 | Grau et al. |
| 2006/0192023 | A1 | | 8/2006 | Franke et al. |
| 2007/0084418 | A1 | | 4/2007 | Gurevich |
| 2007/0119388 | A1 | * | 5/2007 | Waseda et al. ..... 122/7 R |
| 2008/0098926 | A1 | | 5/2008 | Seitz |
| 2008/0104960 | A1 | | 5/2008 | Lomnx et al. |
| 2008/0190382 | A1 | | 8/2008 | Bruckner et al. |
| 2008/0282997 | A1 | | 11/2008 | Gayheart et al. |
| 2009/0071419 | A1 | | 3/2009 | Franke et al. |
| 2009/0151654 | A1 | | 6/2009 | Ando |
| 2009/0241859 | A1 | | 10/2009 | Bairley et al. |
| 2010/0181053 | A1 | | 7/2010 | Hecht et al. |
| 2010/0200203 | A1 | | 8/2010 | Postma et al. |
| 2011/0041783 | A1 | | 2/2011 | Brueckner |
| 2011/0056668 | A1 | | 3/2011 | Taras et al. |
| 2011/0162594 | A1 | | 7/2011 | Brueckner et al. |
| 2011/0174472 | A1 | | 7/2011 | Kurochkin et al. |
| 2011/0225972 | A1 | | 9/2011 | Brueckner et al. |
| 2011/0239961 | A1 | | 10/2011 | Bauver, II et al. |
| 2012/0180739 | A1 | | 7/2012 | Rop et al. |
| 2013/0180471 | A1 | | 7/2013 | Truong et al. |
| 2014/0216365 | A1 | | 8/2014 | Rancruel et al. |

FOREIGN PATENT DOCUMENTS

| | | | | |
|---|---|---|---|---|
| CN | 2429730 | Y | | 5/2001 |
| CN | 1546191 | A | | 11/2004 |
| CN | 1599853 | A | | 3/2005 |
| CN | 1745227 | A | | 3/2006 |
| CN | 1745277 | A | | 3/2006 |
| CN | 101311624 | A | | 11/2008 |
| CN | 101457978 | A | | 6/2009 |
| CN | 201277766 | Y | | 7/2009 |
| CN | 201476631 | U | | 5/2010 |
| CN | 101726202 | A | | 6/2010 |
| CN | 101784861 | A | | 7/2010 |
| CN | 102128557 | A | | 7/2011 |
| CN | 102239363 | A | | 11/2011 |
| DE | 612960 | C | | 5/1935 |
| FR | 1324002 | A | | 4/1963 |
| GB | 28236 | | | 0/1913 |
| GB | 104356 | | * | 2/1917 |
| GB | 490457 | A | | 8/1938 |
| GB | 717420 | | * | 10/1954 |
| GB | 865426 | | | 4/1961 |
| GB | 913010 | A | | 12/1962 |
| JP | 0275806 | A | | 3/1990 |
| JP | 0663606 | B2 | | 8/1994 |
| JP | 06229503 | A | | 8/1994 |
| JP | 0645154 | Y2 | | 11/1994 |
| JP | 06341604 | A | | 12/1994 |
| JP | H09-243002 | | | 9/1997 |
| JP | 2000018501 | A | | 1/2000 |

(56) References Cited

FOREIGN PATENT DOCUMENTS

| | | | |
|---|---|---|---|
| JP | 2002206888 | A | 7/2002 |
| JP | 2008180501 | A | 8/2008 |
| KR | 100284392 | B1 | 4/2001 |
| KR | 20010090529 | A | 10/2001 |
| KR | 1020060132944 | | 12/2006 |
| KR | 20070088654 | A | 8/2007 |
| KR | 20090003233 | A | 1/2009 |
| KR | 20110009042 | U | 9/2011 |
| WO | 8404797 | A1 | 12/1984 |
| WO | 2004011046 | A1 | 2/2004 |
| WO | 2007/133071 | | 11/2007 |

OTHER PUBLICATIONS

First Office Action issued by the Chinese Patent Office for CN Appln. No. 201380000533.3, dated Mar. 17, 2015.
PCT Search Report and Written Opinion issued in connection with Related PCT Application No. PCT/IB2013/050455 dated Sep. 12, 2013.
PCT Search Report and Written Opinion issued in connection with Related PCT Application No. PCT/IB2013/050460 dated Sep. 12, 2013.
PCT Search Report and Written Opinion issued in connection with Related PCT Application No. PCT/IB2013/050457 dated Feb. 20, 2014.
PCT Invitation to Pay Additional Fees issued in connection with Related PCT Application No. PCT/IB2013/050459 dated Feb. 24, 2014.
PCT Search Report and Written Opinion issued in connection with Related PCT Application No. PCT/IB2013/050459 dated May 27, 2014.
Unofficial English Translation of Korean Office Action issued in connection with Related KR Application No. 1020137019920 dated Aug. 8, 2014.
Unofficial English Translation of Chinese Office Action and Search Report issued in connection with Related CN Application No. 201380000535.2 dated Dec. 23, 2014.
Unofficial English Translation of Chinese Office Action and Search Report issued in connection with Related CN Application No. 201380000532.9 dated Jan. 14, 2015.
Unofficial English Translation of Korean Office Action issued in connection with Related KR Application No. 1020137019933 dated Jan. 23, 2015.
Unofficial English Translation of Korean Office Action issued in connection with Related KR Application No. 1020137021217 dated Jan. 23, 2015.
Unofficial English Translation of Korean Office Action issued in connection with Related KR Application No. 1020137021224 dated Jan. 23, 2015.
Unofficial English Translation of Korean Notice of Allowance issued in connection with Related KR Application No. 1020137019920 dated Apr. 27, 2015.
U.S. Notice of Allowance issued in connection with Related U.S. Appl. No. 13/744,104 dated May 20, 2015.
Unofficial English Translation of Chinese Office Action and Search Report issued in connection with Related CN Application No. 201380000531.4 dated May 27, 2015.
U.S. Non-Final Office Action issued in connection with Related U.S. Appl. No. 13/744,094 dated May 27, 2015.
U.S. Non-Final Office Action issued in connection with Related U.S. Appl. No. 13/744,112 dated Jun. 19, 2015.
Unofficial English Translation of Mexican Office Action issued in connection with Related MX Application No. Mx/a/2013/008237 dated Jul. 24, 2015.
Unofficial English Translation of Chinese Office Action and Search Report issued in connection with Related CN Application No. 201380000530.X dated Sep. 6, 2015.
U.S. Non-Final Office Action issued in connection with Related U.S. Appl. No. 13/744,121 dated Sep. 28, 2015.
Unofficial English Translation of Korean Office Action issued in connection with Related KR Application No. 1020137019933 dated Oct. 29, 2015.
Unofficial English Translation of Indonesian Office Action issued in connection with Related ID Application No. W00201302867 dated Nov. 5, 2015.
Unofficial English Translation of Korean Notice of Allowance issued in connection with Related KR Application No. 1020137021217 dated Nov. 27, 2015.
Unofficial English Translation of Korean Office Action issued in connection with Related KR Application No. 1020137021477 dated Dec. 24, 2015.
Unofficial English Translation of CN Office Action and Search Report issued in connection with Related CN Application No. 201380000531.4 dated Dec. 24, 2015.
U.S. Final Office Action issued in connection with Related U.S. Appl. No. 13/744,094 dated Jan. 13, 2016.
Unofficial English Translation of Korean Office Action issued in connection with Related KR Application No. 1020137019933 dated Feb. 26, 2016.
U.S. Final Office Action issued in connection with Related U.S. Appl. No. 13/744,112 dated Feb. 26, 2016.
Unofficial English Translation of Mexican Office Action issued in connection with Related MX Application No. MX/a/2013/008237 dated Apr. 5, 2016.
Unofficial English Translation of Chinese Office Action and Search Report issued in connection with Related CN Application No. 201380000530.X dated Apr. 25, 2016.
Unofficial English Translation of Korean Office Action issued in connection with Related KR Application No. 1020137021224 dated May 4, 2016.
U.S. Final Office Action issued in connection with Related U.S. Appl. No. 13/744,121 dated May 20, 2016.
European Office Action issued in connection with corresponding EP Application No. 13707443.1 dated May 25, 2016.
U.S. Non-Final Office Action issued in connection with Related U.S. Appl. No. 13/744,094 dated Jun. 28, 2016.
U.S. Non-Final Office Action issued in connection with Related U.S. Appl. No. 13/744,112 dated Aug. 11, 2016.
Unofficial English Translation of Mexican Office Action issued in connection with Related MX Application No. Mx/a/2013/008024 dated Jul. 28, 2016.
U.S. Appl. No. 61/587,230, filed Jan. 17, 2012.
U.S. Appl. No. 61/587,402, filed Jan. 17, 2012.
Unofficial English Translation of Office Action issued in connection with corresponding Indonesian Application No. W00201303028 dated Nov. 20, 2017.

* cited by examiner

View along A-A'

Section along B-B' Isometric View of the Baffle System (240)

TUBE AND BAFFLE ARRANGEMENT IN A ONCE-THROUGH HORIZONTAL EVAPORATOR

CROSS-REFERENCE TO RELATED APPLICATIONS

This disclosure claims priority to U.S. Provisional Application No. 61/587,332 filed Jan. 17, 2012, U.S. Provisional Application No. 61/587,230 filed Jan. 17, 2012, U.S. Provisional Application No. 61/587,428 filed Jan. 17, 2012, U.S. Provisional Application No. 61/587,359 filed Jan. 17, 2012, and U.S. Provisional Application No. 61/587,402 filed Jan. 17, 2012, the entire contents of which are all hereby incorporated by reference.

TECHNICAL FIELD

The present disclosure relates generally to a heat recovery steam generator (HRSG), and more particularly, to a baffle for controlling flow in an HRSG having horizontal and/or inclined tubes for heat exchange.

BACKGROUND

A heat recovery steam generator (HRSG) is an energy recovery heat exchanger that recovers heat from a hot gas stream. It produces steam that can be used in a process (cogeneration) or used to drive a steam turbine (combined cycle). Heat recovery steam generators generally comprise four major components—the economizer, the evaporator, the superheater and the water preheater. In particular, natural circulation HRSG's contain an evaporator heating surface, a drum, as well as piping to facilitate an appropriate circulation rate in the evaporator tubes. A once-through HRSG replaces the natural circulation components with the once-through evaporator and in doing so offers in-roads to higher plant efficiency and furthermore assists in prolonging the HRSG lifetime in the absence of a thick walled drum.

An example of a once through evaporator heat recovery steam generator (HRSG) 100 is shown in the FIG. 1. In the FIG. 1, the HRSG comprises vertical heating surfaces in the form of a series of vertical parallel flow paths/tubes 104 and 108 (disposed between the duct walls 111) configured to absorb the required heat. In the HRSG 100, a working fluid (e.g., water) is transported to an inlet manifold 105 from a source 106. The working fluid is fed from the inlet manifold 105 to an inlet header 112 and then to a first heat exchanger 104, where it is heated by hot gases from a furnace (not shown) flowing in the horizontal direction. The hot gases heat tube sections 104 and 108 disposed between the duct walls 111. A portion of the heated working fluid is converted to a vapor and the mixture of the liquid and vaporous working fluid is transported to the outlet manifold 103 via the outlet header 113, from where it is transported to a mixer 102, where the vapor and liquid are mixed once again and distributed to a second heat exchanger 108. This separation of the vapor from the liquid working fluid is undesirable as it produces temperature gradients and efforts have to be undertaken to prevent it. To ensure that the vapor and the fluid from the heat exchanger 104 are well mixed, they are transported to a mixer 102, from which the two phase mixture (vapor and liquid) are transported to another second heat exchanger 108 where they are subjected to superheat conditions. The second heat exchanger 108 is used to overcome thermodynamic limitations. The vapor and liquid are then discharged to a collection vessel 109 from which they are then sent to a separator 110, prior to being used in power generation equipment (e.g., a turbine). The use of vertical heating surfaces thus has a number of design limitations.

Due to design considerations, it is often the case that thermal head limitations use an additional heating loop in order to achieve superheated steam at the outlet. Often times, additional provisions are needed to remix water/steam bubbles prior to re-entry into the second heating loop, leading to additional design considerations. In addition, there exists a gas-side temperature imbalance downstream of the heating surface as a direct result of the vertically arranged parallel tubes. These additional design considerations utilize additional engineering design and manufacturing, both of which are expensive. These additional features also necessitate periodic maintenance, which reduces time for the productive functioning of the plant and therefore result in losses in productivity. It is therefore desirable to overcome these drawbacks.

In addition, when a number of vertical tube sections (having vertical tubes) are placed next to one another, a substantial portion of the hot gases pass through the gaps between adjacent vertical sections without contacting the tube surfaces. This results in a loss of heat. It is therefore desirable to minimize the loss of heat due to the unrestricted flow of hot gases through open spaces between evaporator sections.

SUMMARY

Disclosed herein is a once-through evaporator comprising an inlet manifold; one or more inlet headers in fluid communication with the inlet manifold; one or more tube stacks, where each tube stack comprises one or more inclined evaporator tubes; the one or more tube stacks being in fluid communication with the one or more inlet headers; where the inclined tubes are inclined at an angle of less than 90 degrees or greater than 90 degrees to a vertical; one or more outlet headers in fluid communication with one or more tube stacks; and an outlet manifold in fluid communication with the one or more outlet headers; and a baffle system comprising a plurality of baffles; the baffle system being disposed adjacent to a tube stack so that the baffle system contacts a tube.

Disclosed herein too is a method comprising discharging a working fluid through a once-through evaporator; where the once-through evaporator comprises an inlet manifold; one or more inlet headers in fluid communication with the inlet manifold; one or more tube stacks, where each tube stack comprises one or more inclined evaporator tubes; the one or more tube stacks being in fluid communication with the one or more inlet headers; where the inclined tubes are inclined at an angle of less than 90 degrees or greater than 90 degrees to a vertical; one or more outlet headers in fluid communication with one or more tube stacks; and an outlet manifold in fluid communication with the one or more outlet headers; and a baffle system comprising a plurality of baffles; the baffle system being disposed adjacent to a tube stack so that the baffle system contacts a tube; discharging a hot gas through the once-through evaporator; and transferring heat from the hot gas to the working fluid.

BRIEF DESCRIPTION OF THE DRAWINGS

Referring now to the Figures, which are exemplary embodiments, and wherein the like elements are numbered alike.

DETAILED DESCRIPTION

Disclosed herein is a heat recovery steam generator (HRSG) that comprises a plurality of heat exchanger sections (hereinafter tube stacks) whose tubes are arranged to be "non-vertical". The tube stacks have a baffle disposed between them. The baffle redirects the hot gases into the tube stacks. This facilitates improved heat transfer from the hot gases to a working fluid that travels in the tube stacks.

Figure 1:
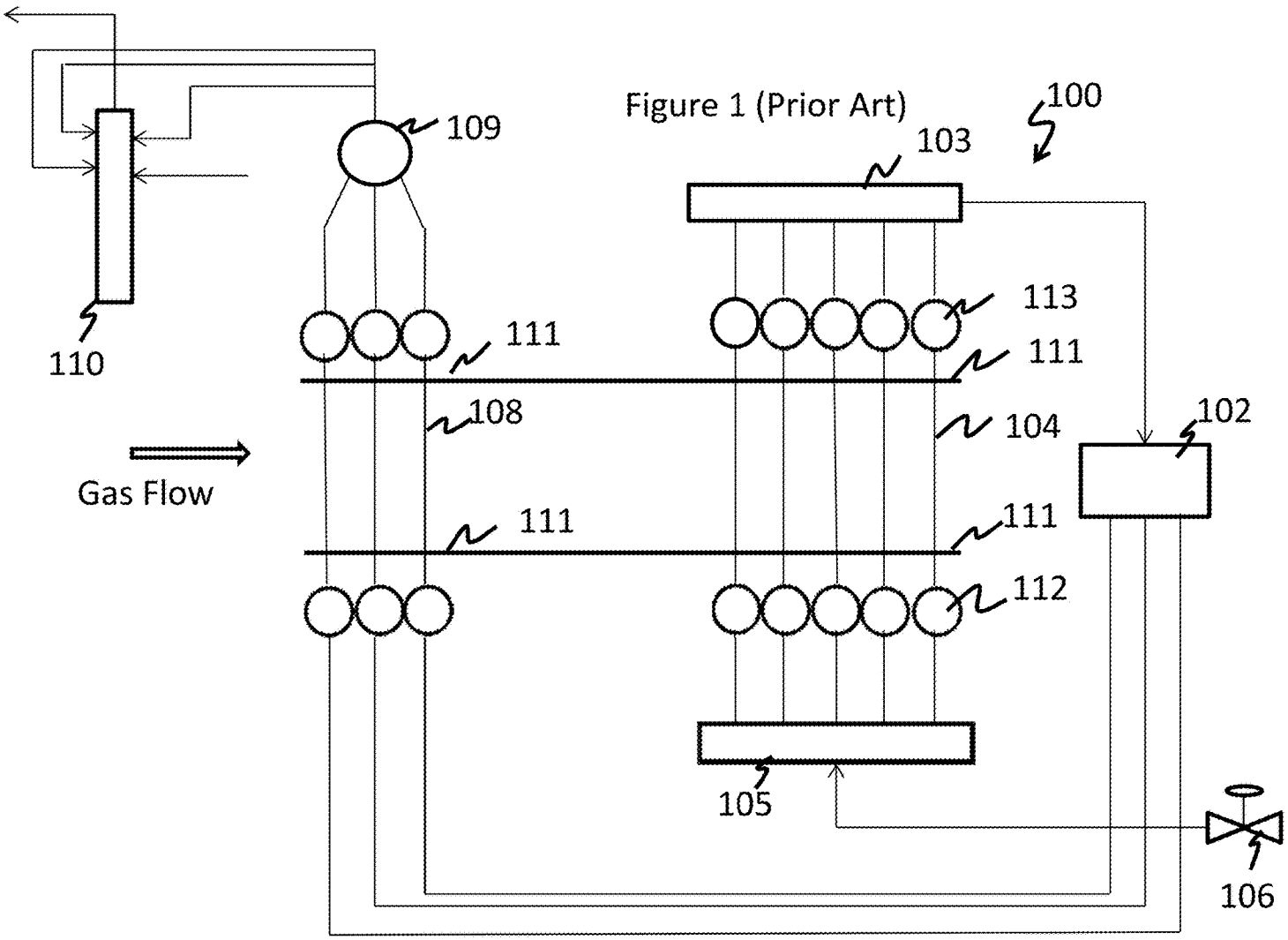
Figure 1 (Prior Art)
FIG. 1 is a schematic view of a prior art heat recovery steam generator having vertical heat exchanger tubes.
Figure 2:
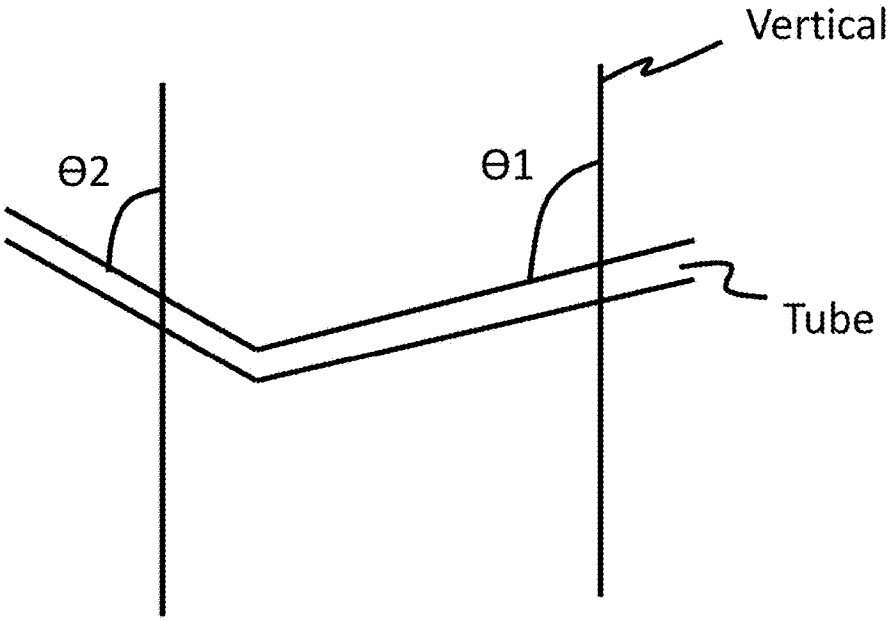
FIG. 2 depicts a schematic view of an exemplary once-through evaporator that uses a counterflow staggered arrangement.

By non-vertical, it is implied the tubes are inclined at an angle to a vertical. By "inclined", it is implied that the individual tubes are inclined at an angle less than 90 degrees or greater than 90 degrees to a vertical line drawn across a tube. In one embodiment, the tubes can be horizontal in a first direction and inclined in a second direction that is perpendicular to the first direction. These angular variations in the tube along with the angle of inclination are shown in the FIG. 2. The FIG. 2 shows a section of a tube that is employed in a tube stack of the once-through evaporator. The tube stack shows that the tube is inclined to the vertical in two directions. In one direction, it is inclined at an angle of θ1 to the vertical, while in a second direction it is inclined at angle of θ2 to the vertical. In the FIG. 2, it may be seen that θ1 and θ2 can vary by up to 90 degrees to the vertical. If the angle of inclination θ1 and θ2 are equal to 90 degrees, then the tube is stated to be substantially horizontal. If on the other hand only one angle θ1 is 90 degrees while the other angle θ2 is less than 90 degrees or greater than 90 degrees but less than 180 degrees, then the tube is said to be horizontal in one direction while being inclined in another direction. In yet another embodiment, it is possible that both θ1 and θ2 are less than 90 degrees or greater than 90 degrees but less than 180 degrees, which implies that the tube is inclined in two directions. It is to be noted that by "substantially horizontal" it is implies that the tubes are oriented to be approximately horizontal (i.e., arranged to be parallel to the horizon within ±2 degrees). For tubes that are inclined, the angle of inclination θ1 and/or θ2 generally vary from about 30 degrees to about 88 degrees with the vertical. In other words, they can vary from 3 degrees to 60 degrees to the horizontal.

The section (or plurality of sections) containing the horizontal tubes is also termed a "once-through evaporator", because when operating in subcritical conditions, the working fluid (e.g., water, ammonia, or the like) is converted into vapor gradually during a single passage through the section from an inlet header to an outlet header. Likewise, for supercritical operation, the supercritical working fluid is heated to a higher temperature during a single passage through the section from the inlet header to the outlet header.

The once-through evaporator (hereinafter "evaporator") comprises parallel tubes that are disposed non-vertically in at least one direction that is perpendicular to the direction of flow of heated gases emanating from a gas turbine, furnace or boiler.

Figure 3:
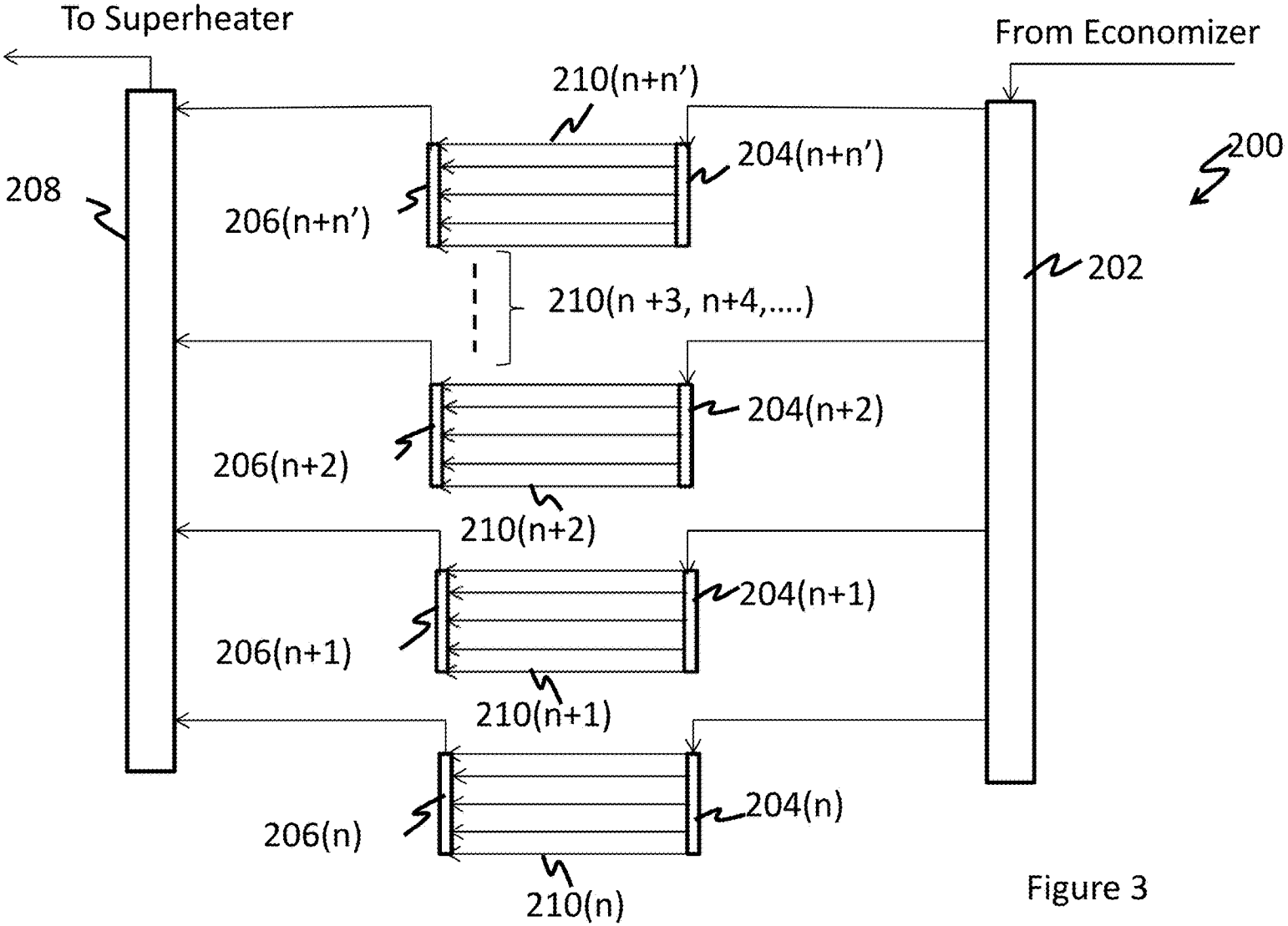
FIG. 3 depicts an exemplary embodiment of a once-through evaporator.
Figure 9:
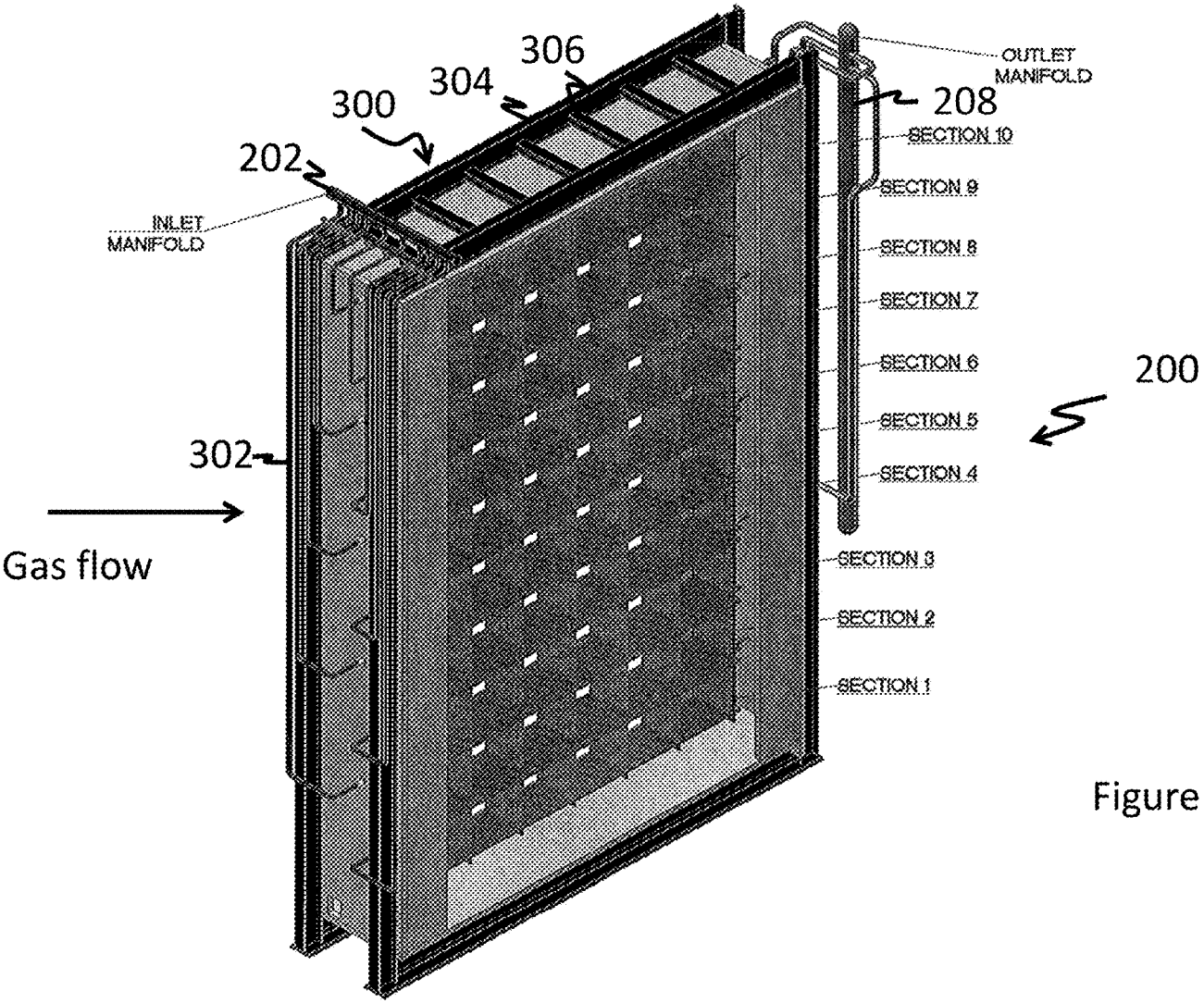
FIG. 9 shows a once-through evaporator having 10 vertically aligned tube stacks that contain tubes through which hot gases can pass in order to transfer their heat to the working fluid.

The FIGS. 3 and 9 depict an exemplary embodiment of a once-through evaporator. The FIG. 3 depicts a plurality of vertical tube stacks in a once-through evaporator 200. In one embodiment, the tube stacks are aligned vertically so that each stack is either directly above, directly under, or both directly above and/or directly under another tube stack. The evaporator 200 comprises an inlet manifold 202, which receives a working fluid from an economizer (not shown) and transports the working fluid to a plurality of inlet headers 204($n$), each of which are in fluid communication with vertical tube stacks 210($n$) comprising one or more tubes that are substantially horizontal. The fluid is transmitted from the inlet headers 204($n$) to the plurality of tube stacks 210($n$). For purposes of simplicity, in this specification, the plurality of inlet headers 204($n$), 204($n$+1) . . . and 204($n$+$n'$), depicted in the figures are collectively referred to as 204($n$). Similarly the plurality of tube stacks 210($n$), 210($n$+1), 210($n$+2) . . . and 210($n$+$n'$) are collectively referred to as 210($n$) and the plurality of outlet headers 206($n$), 206($n$+1), 206($n$+2) . . . and 206($n$+$n'$) are collectively referred to as 206($n$).

As can be seen in the FIG. 3, multiple tube stacks 210($n$) are therefore respectively vertically aligned between a plurality of inlet headers 204($n$) and outlet headers 206($n$). Each tube of the tube stack 210($n$) is supported in position by a plate (not shown). The working fluid upon traversing the tube stack 210($n$) is discharged to the outlet manifold 208 from which it is discharged to the superheater. The inlet manifold 202 and the outlet manifold 208 can be horizontally disposed or vertically disposed depending upon space requirements for the once-through evaporator. The FIG. 2 shows a vertical inlet manifold.

The hot gases from a source (e.g., a furnace or boiler) (not shown) travel perpendicular to the direction of the flow of the working fluid in the tubes 210. The hot gases flow into the plane of the paper or out of the plane of the paper in the FIG. 3. In one embodiment, the hot gases travel counterflow to the direction of travel of the working fluid in the tube stack. Heat is transferred from the hot gases to the working fluid to increase the temperature of the working fluid and to possibly convert some or all of the working fluid from a liquid to a vapor. Details of each of the components of the once-through evaporator are provided below.

As seen in the FIG. 3, the inlet header comprises one or more inlet headers 204($n$), 204($n$+1) . . . and (204($n$)

(hereinafter represented generically by the term "204(*n*)"), each of which are in operative communication with an inlet manifold 202. In one embodiment, each of the one or more inlet headers 204(*n*) is in fluid communication with an inlet manifold 202. The inlet headers 204(*n*) are in fluid communication with a plurality of horizontal tube stacks 210(*n*), 210(*n*+1), 210(*n'*+2) . . . and 210(*n*) respectively ((hereinafter termed "tube stack" represented generically by the term "210(*n*)"). Each tube stack 210(*n*) is in fluid communication with an outlet header 206(*n*). The outlet header thus comprises a plurality of outlet headers 206(*n*), 206(*n*+1), 206 (*n*+2) . . . and 206(*n*), each of which is in fluid communication with a tube stack 210(*n*), 210(*n*+1), 210(*n*+2) . . . and 210(*n*) and an inlet header 204(*n*), 204(*n*+1), (204(*n*+2) . . . and (204(*n*) respectively.

The terms 'n" is an integer value, while "n'" can be an integer value or a fractional value. n' can thus be a fractional value such as ½, ⅓, and the like. Thus for example, there can therefore be one or more fractional inlet headers, tube stacks or outlet headers. In other words, there can be one or more inlet headers and outlet headers whose size is a fraction of the other inlet headers and/or outlet headers. Similarly there can be tube stacks that contain a fractional value of the number of tubes that are contained in the other stack. It is to be noted that the valves and control systems having the reference numeral n' do not actually exist in fractional form, but may be downsized if desired to accommodate the smaller volumes that are handled by the fractional evaporator sections.

In one embodiment, the once-through evaporator can comprise 2 or more inlet headers in fluid communication with 2 or more tube stacks which are in fluid communication with 2 or more outlet headers. In another embodiment, the once-through evaporator can comprise 5 or more inlet headers in fluid communication with 5 or more tube stacks which are in fluid communication with 5 or more outlet headers. In yet another embodiment, the once-through evaporator can comprise 10 or more inlet headers in fluid communication with 10 or more tube stacks which are in fluid communication with 10 or more outlet headers. There is no limitation to the number of tube stacks, inlet headers and outlet headers that are in fluid communication with each other and with the inlet manifold and the outlet manifold. Each tube stack is sometimes termed a zone.

The FIG. 9 depicts another assembled once-through evaporator. The FIG. 9 shows a once-through evaporator having 10 vertically aligned tube stacks 210(*n*) that contain tubes through which hot gases can pass to transfer their heat to the working fluid. The tube stacks are mounted in a frame 300 that comprises two parallel vertical support bars 302 and two horizontal support bars 304. The support bars 302 and 304 are fixedly attached or detachably attached to each other by welds, bolts, rivets, screw threads and nuts, or the like.

Disposed on an upper surface of the once-through evaporator are rods 306 that contact the plates 250. Each rod 306 supports the plate and the plates hang (i.e., they are suspended) from the rod 306. The plates 250 (as detailed above) are locked in position using clevis plates. The plates 250 also support and hold in position the respective tube stacks 210(*n*). In this FIG. 9, only the uppermost tube and the lowermost tube of each tube tack 210(*n*) is shown as part of the tube stack. The other tubes in each tube stack are omitted for the convenience of the reader and for clarity's sake.

Since each rod 306 holds or supports a plate 250, the number of rods 306 are therefore equal to the number of the plates 250. In one embodiment, the entire once-through evaporator is supported and held-up by the rods 306 that contact the horizontal rods 304. In one embodiment, the rods 306 can be tie-rods that contact each of the parallel horizontal rods 304 and support the entire weight of the tube stacks. The weight of the once-through evaporator is therefore supported by the rods 306.

Each section is mounted onto the respective plates and the respective plates are then held together by tie rods 300 at the periphery of the entire tube stack. A number of vertical plates support these horizontal heat exchangers. These plates are designed as the structural support for the module and provide support to the tubes to limit deflection. The horizontal heat exchangers are shop assembled into modules and shipped to site. The plates of the horizontal heat exchangers are connected to each other in the field.

Figure 4B:
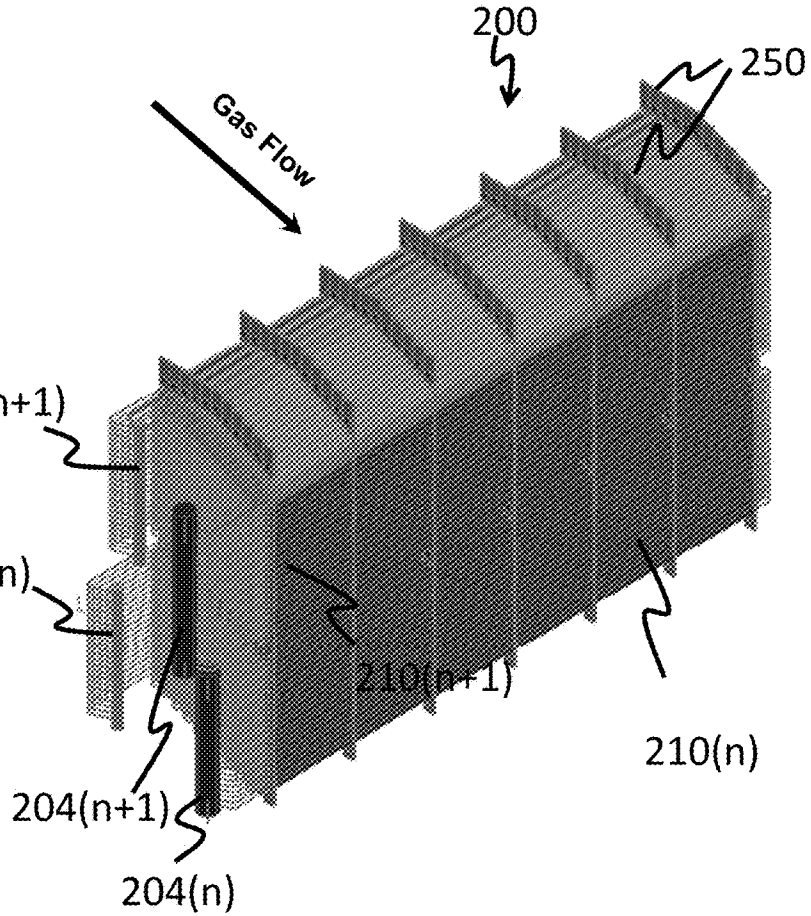
FIG. 4(B) depicts an isometric view of an exemplary arrangement of the tubes in a tube stack of a once-through evaporator.
Figure 4A:
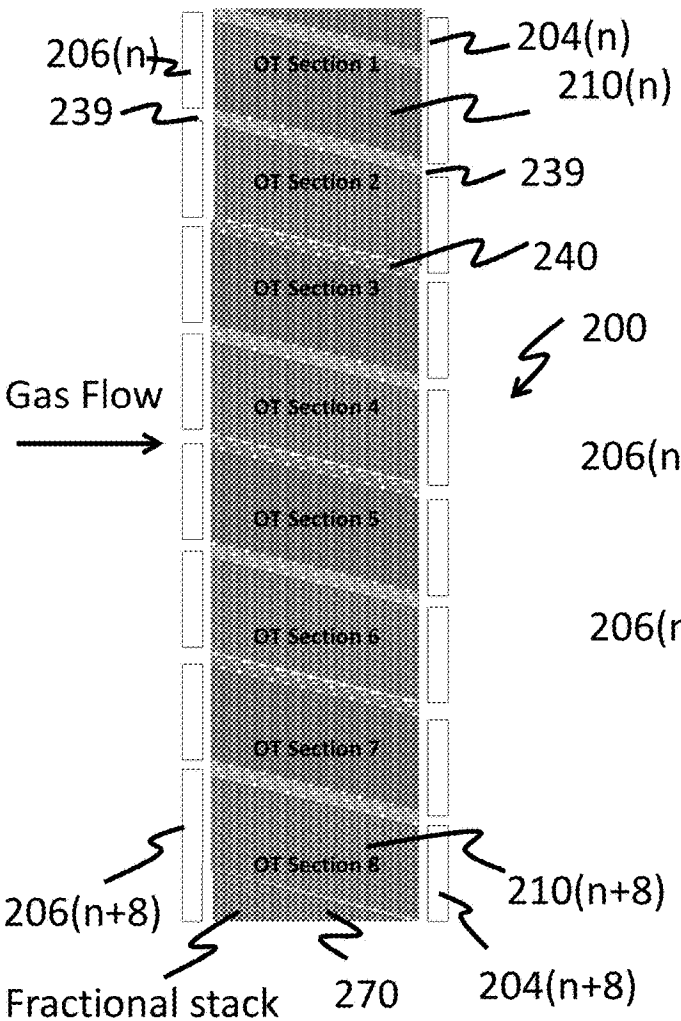
FIG. 4(A) depicts one exemplary arrangement of the tubes in a tube stack of a once-through evaporator.

The tubes in each tube stack are serpentine as shown in the FIGS. 4(A) and 4(B) below. The FIGS. 4(A) and 4(B) depict one exemplary arrangement of the tubes in a tube stack of a once-through evaporator 200. The nomenclature adopted in the FIGS. 4(A) and 4(B) is the same as that described previously in the FIG. 3 and hence will not be repeated here. In the FIG. 4(A) a once through evaporator 200 having 8 tube stacks (referred to as tube sections) are vertically aligned. The tube stacks have a passage 239 between successive stacks through which the hot gases pass unimpeded. As will be discussed shortly, this is problematic because it results in the heat being unused resulting in a decrease in efficiency of the once-through evaporator. The FIG. 4(B) is an isometric view of the lower two tube stacks. In the FIG. 4(B), 2 tube sections are supported by 7 metal plates 250.

Figure 5:
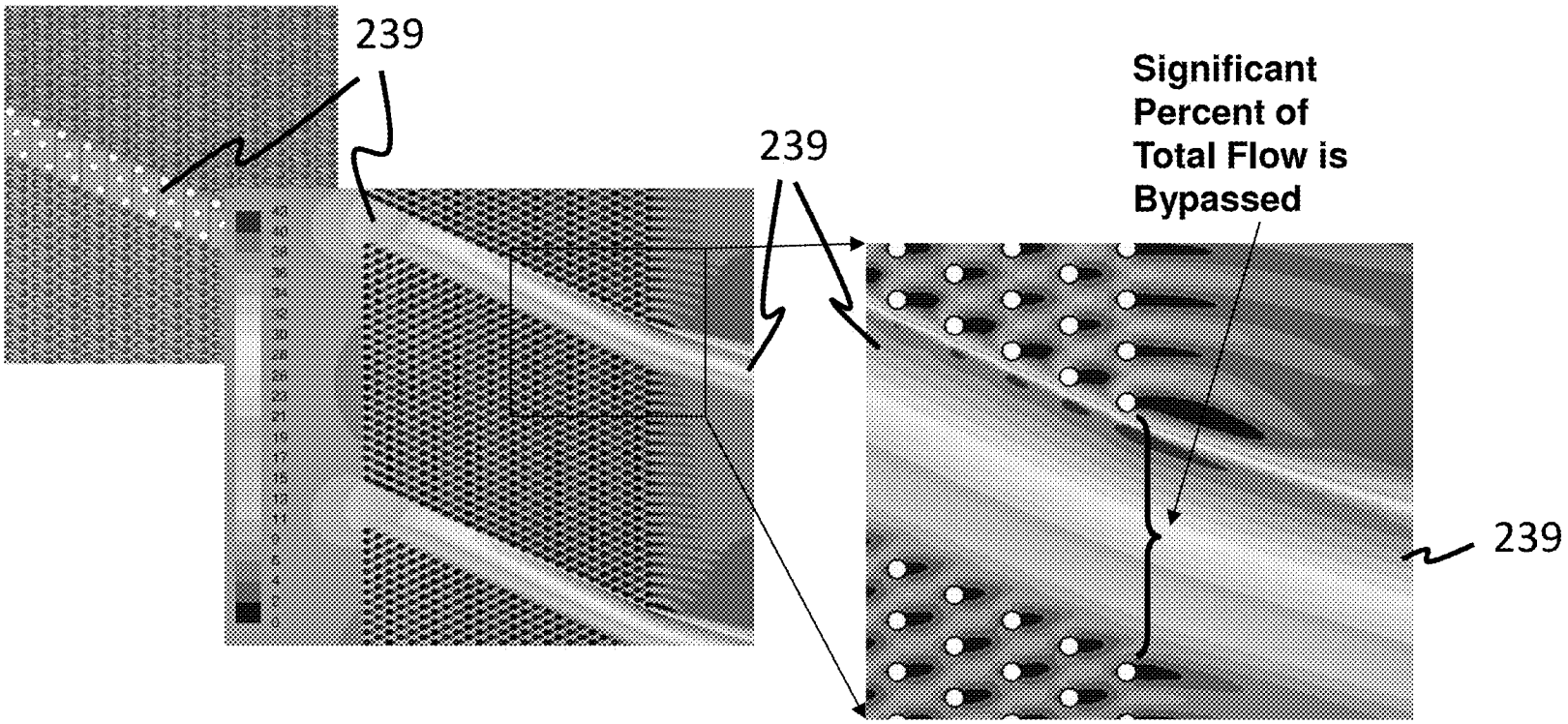
FIG. 5 depicts a by-pass problem that occurs when no baffles are present in the passage between tube stacks that are vertically aligned on one another.

The FIG. 5 depicts the problem when no baffles are present in the passage 239 between tube stacks that are vertically aligned on one another. As can be seen the hot gases pass directly through the passage without interacting with the tubes of the tube stack 210(*n*). Significant hot gas bypass thus occurs resulting in reduced efficiency.

Similarly, if a poorly designed distributive element were to be placed in the passage, non-uniform flow distribution would occur in the tube stacks.

Figure 6:
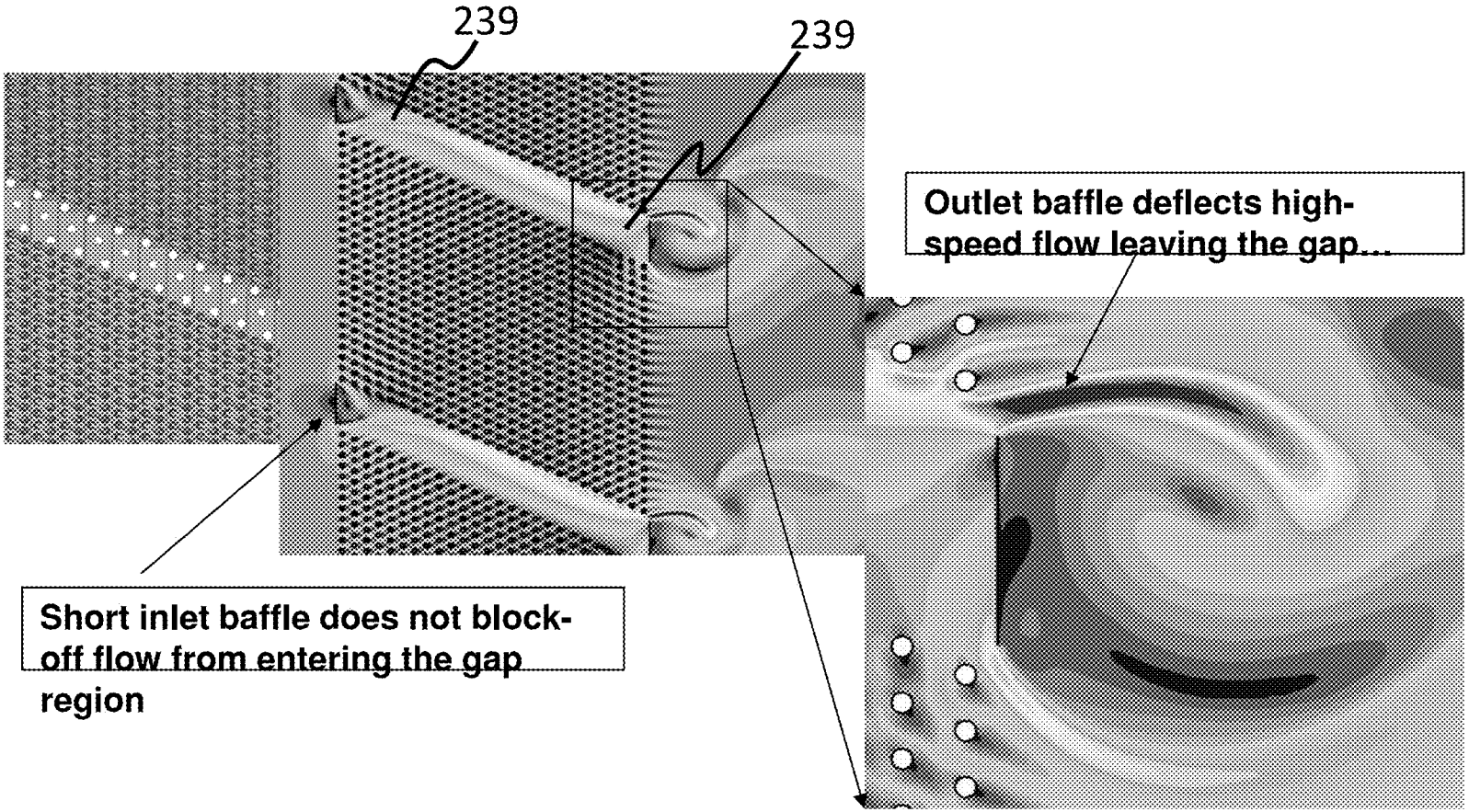
FIG. 6 depicts a mal-distribution problem that occurs when an improperly designed baffle is used in the passage between tube stacks.

In one embodiment, depicted in the FIG. 6, a short inlet baffle and outlet baffle may be placed at the beginning of the passage 239 and at the end of the passage 239 respectively. The short baffles do not successfully block-off hot gases from entering the passage. The outlet baffle placed at the outlet of the baffle deflects high-speed flow leaving a gap in the flow of the hot gases. The use of only one or two baffles (as depicted in the FIG. 6) produces some deflection of gases into the tube stacks surrounding the passage 239. However it is desirable for a well-designed baffle system to mitigate gas bypass and at the same time facilitate uniform distribution of hot gases in the tube stack so as to maintain a staggered and counterflow heat transfer in the tube stack.

Figure 7A:
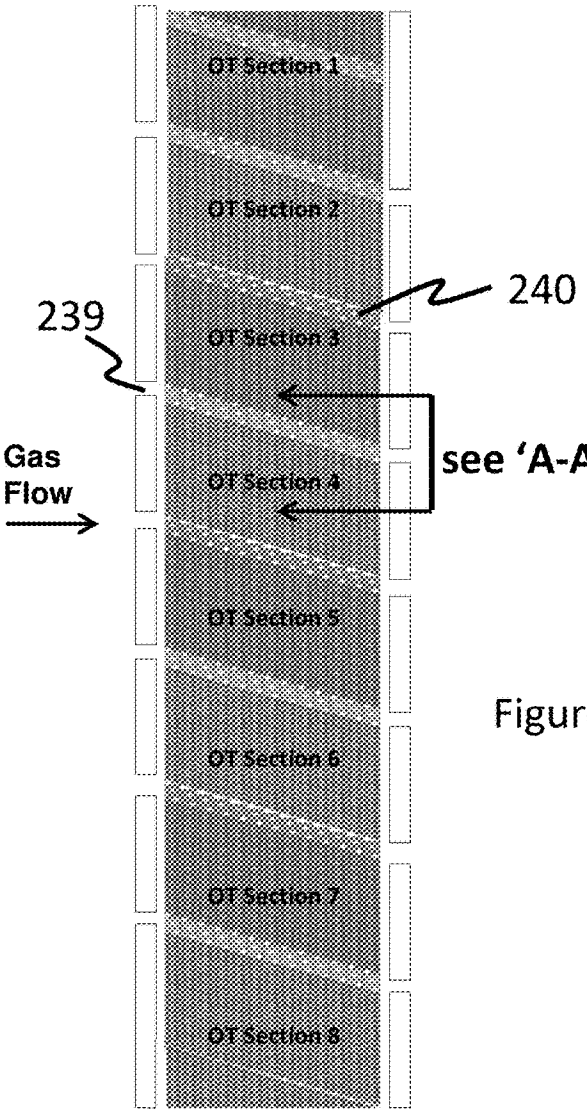
FIG. 7(A) is an exemplary depiction of a tube stack with a baffle system disposed in a gap between two adjacent tube stacks.
Figure 7B:
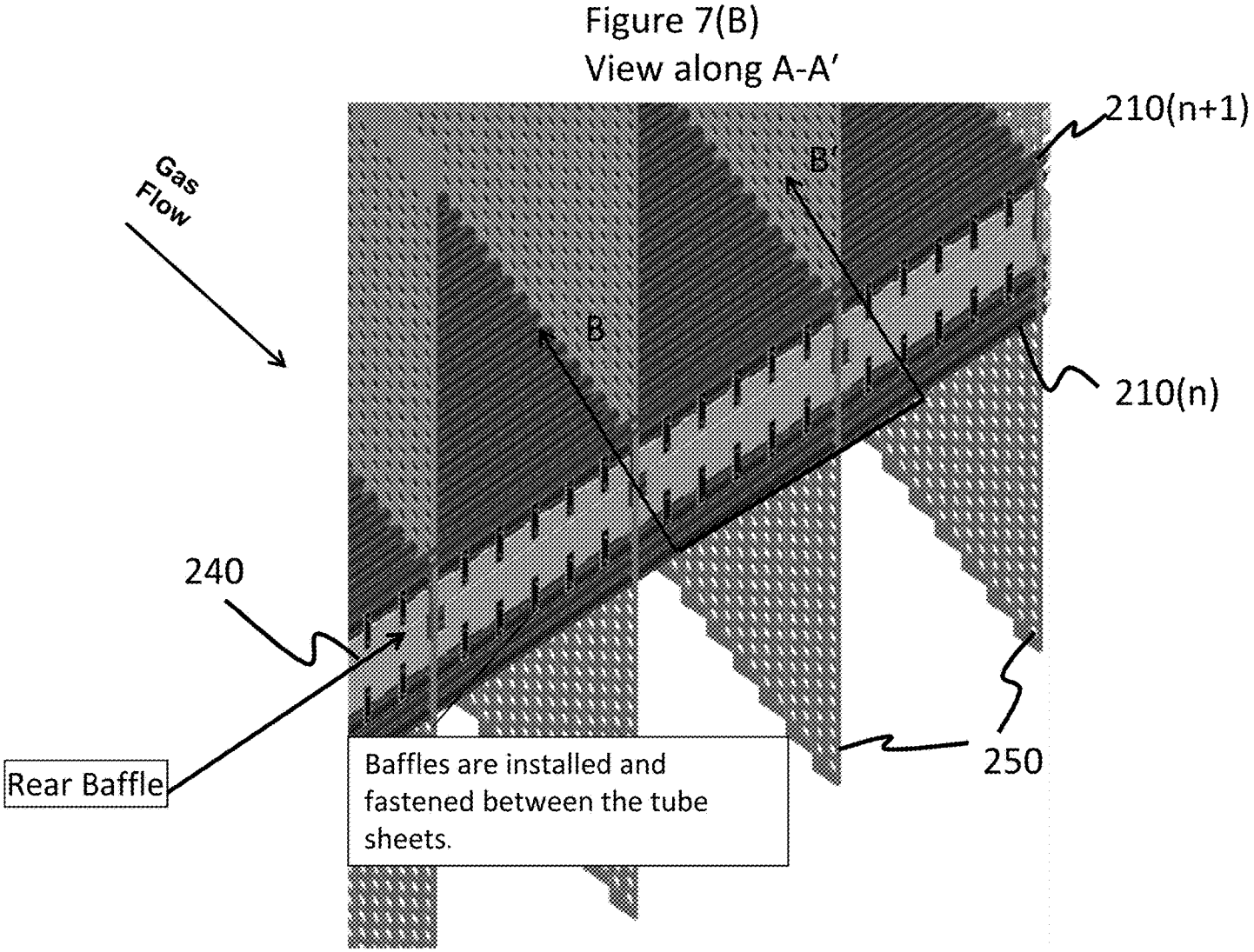
FIG. 7(B) is an exemplary depiction of a tube stack with a baffle system that is a depiction of section A-A' from the FIG. 7(A)
Figure 7C:
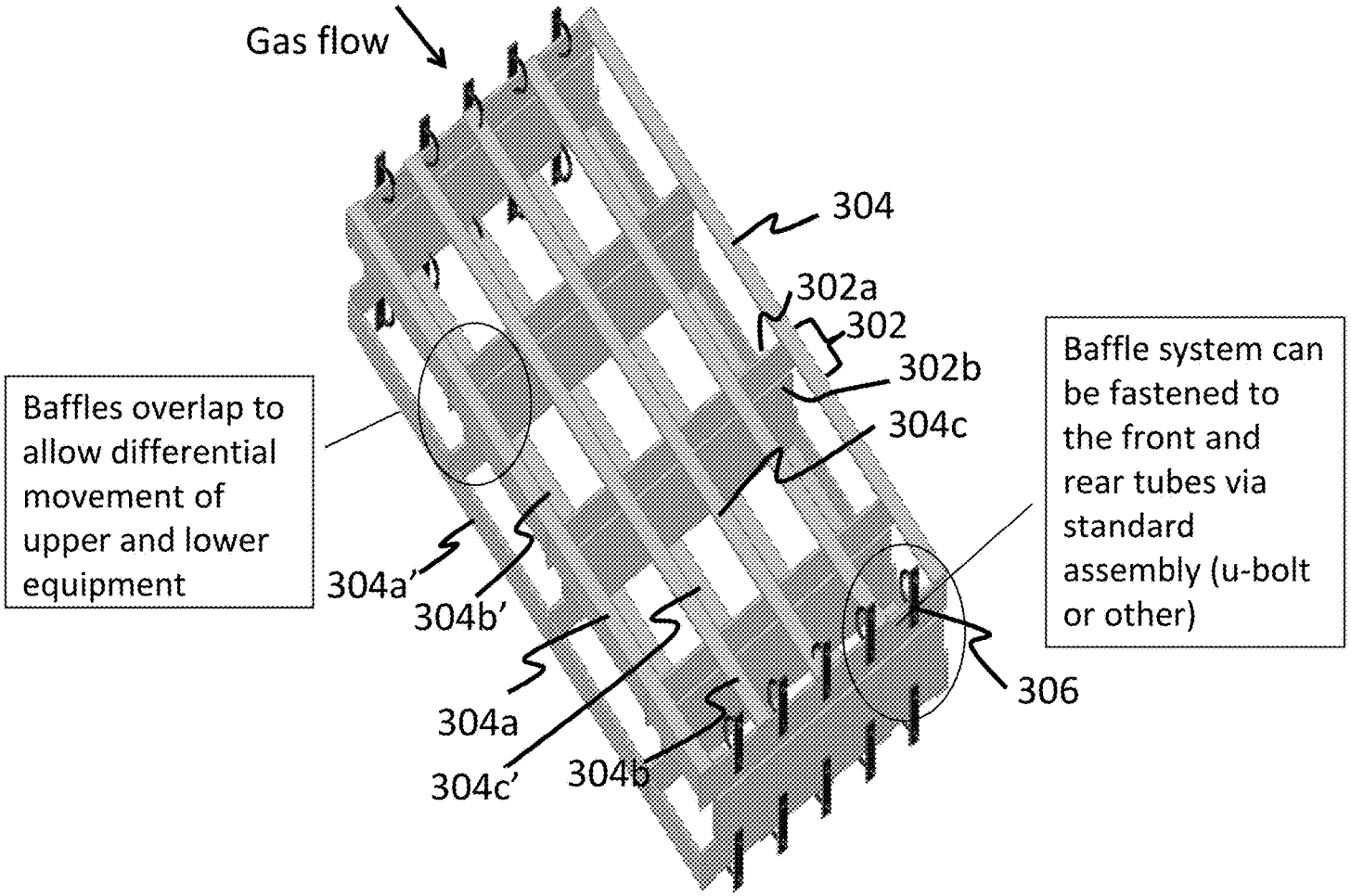
FIG. 7(C) is an exemplary depiction of a baffle system that is a depiction of section B-B' from the FIG. 7(B)

The FIG. 7(A) depicts a tube stack 200 that contains the passage 239 into which a baffle system 240 that comprises a plurality of baffles 302 (see FIG. 7(C)) are placed as clearly depicted in the FIG. 7(B). The FIG. 7(B) is a depiction of section A-A' of the FIG. 7(A), while the FIG. 7(C) is a depiction of the baffle system 240 as seen in the section B-B' of the FIG. 7(B). As can be seen the FIG. 7(B), the baffle system 240 is disposed between two tube stacks 210(*n*+1) and 210(*n*). The baffle system 240 is installed and fastened between a pair of metal plates 250 (that also support the tubes of the tube stacks). The fastening may be accomplished by nuts, bolts, screws, welds and the like if desired. The number of baffle systems 240 is therefore less than or equal to the number of metal plates 250 that are used to support the tube stacks. In an exemplary embodiment, the number of baffle systems 240 is generally one less than the number of metal plates that are used to support the tube stacks.

The baffle system 240 is also provided with clips 306 by which they can be fastened to the lowest tube of the upper stack 210($n$+1) and the uppermost tube of the lower stack 210($n$). The clips 306 can be u-bolts or some other type of fastener. All bolts and other types of fasteners must be capable of surviving the temperature of operation of the once-through evaporator. As can be seen in the FIGS. 7(B) and 7(C), a plurality of clips 306 are used to attach each baffle system 240 to the lowest tube of the upper tube stack 210($n$+1) and the uppermost tube of the lower tube stack 210($n$).

Details of the baffle system 240 are shown in the FIG. 7(C). The baffle system 240 comprises a plurality of baffles 302 that are either fixedly attached or flexibly attached to a frame 304. Additionally, baffles can be individually installed and/or installed by some other means. The flexible attachment permits the baffle system 240 to have its angles changed in order to change the distribution of hot gases through the tube stack. The frame 304 comprises a plurality of parallel rods 304*a*, 304*a*', 304*b*, 304*b*', 304*c*, 304*c*', and so on, that are welded to the plurality of baffles 302 to form the baffle system. The rods 304*a*, 304*b*, 304*c*, and so on, are parallel to each other and lie on the upper side of the plurality of baffles 302, while the rods 304*a*', 304*b*', 304*c*', and so on are parallel to each other and lie on the lower side of the plurality of baffles 302.

As seen in the FIG. 7(C), each baffle 302 comprises a set of parallel plates 302*a* and 302*b* that are fixedly attached or moveably attached on their upper surfaces to the rods 304*a*, 304*b* and 340*c*, and the like, and on their lower surface to the rods 304*a*', 304*b*', and 304*c*', and the like. The movement of the rods 304*a*, 304*b* and 340*c* relative to the rods 304*a*', 304*b*', and 304*c*' can be used to vary the positions of the baffles. In one embodiment, only the positions of some of the baffles can be varied, while the position of some of the other baffles is fixed. While the plates in the FIG. 7(C) are flat, they can also be curved and can be perforated. The perforations can be uniform or distributed.

In another embodiment, the baffles can comprise a single plate or a plurality of plates that are perforated (not shown). These baffles may have a rod, or ribs or bars to reinforce the baffles. The perforation allows for deflection of the hot gases to the tube stacks either above, below or above and below the baffle system. The rods, ribs or reinforcing bars can be on the upstream side or the downstream side of the individual baffles.

In one embodiment, the rods are welded to the plurality of baffles 302. In another embodiment, the rods can be attached to the plurality of baffles 302 by hinges (not shown). This latter arrangement permits the baffles to be angled with respect to the rods. By moving the rods 304*a*, 304*b*, 304*c*, and so on, on one side of the baffles with respect to the rods 304*a*', 304*b*', 304*c*', and so on, on the other side of the baffles, the baffles can be inclined towards the direction from which the hot gases flow or away from the direction from which the hot gases flow. The baffles 302 can be inclined at an angle of 1 to 179 degrees to the vertical. The angle of inclination of the baffles may be the same or different from the inclination of the tube stacks.

The plurality of baffles 302 disposed between the rods can vary depending upon the size of the tube stack. In an exemplary embodiment, there are at least 3 sets of baffles (parallel plates) 302, specifically at least 5 sets of plates, and more specifically at least 6 sets of plates per baffle system 240. In one embodiment, the baffles 302 are equidistantly spaced along the length of the rods. In another embodiment, the baffles 302 are not equidistantly spaced along the length of the rods. The angles between the baffles 302 and the rods 304*a*, 304*b*, 30*c*, etc., can be changed if desired to improve the distribution efficiency.

In one embodiment, the angle of inclination of the baffles may be changed by an actuator (not shown) that is in operative communication with a computer and a sensor (or a plurality of sensors) that is disposed in the once-through evaporator. The actuator can be activated by the reading from the sensor (e.g., a temperature sensor), a load requirement (such as electrical output), and the like. The entire feedback loop comprising the computer, the sensor and the actuator can be automated.

Figure 8:
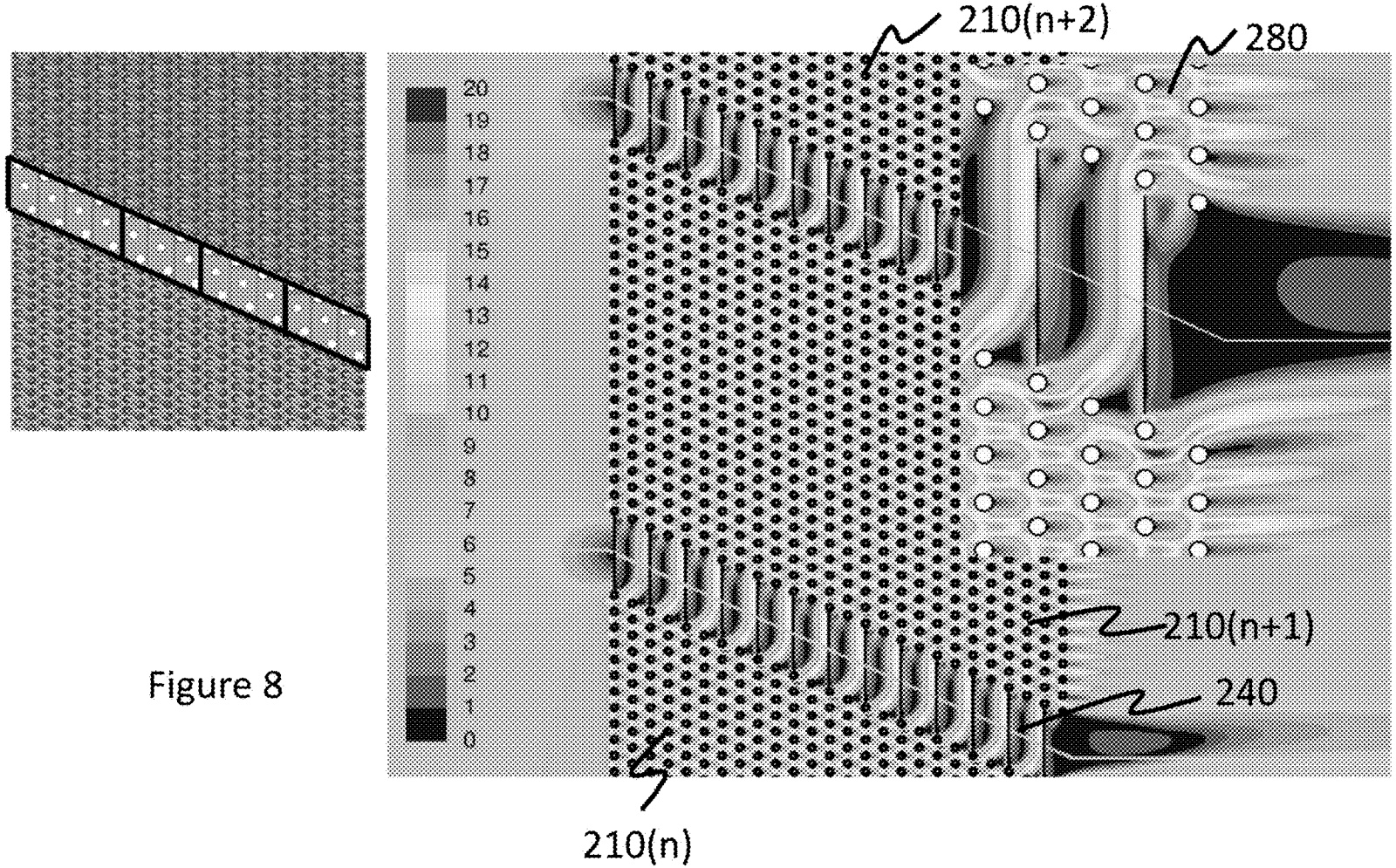
FIG. 8 is an exemplary depiction of the hot gas distribution in a once-through evaporator system that contains the baffle system.

When the baffle system 240 is placed in position in the passage 239 between the tube stacks, the hot gases are uniformly distributed into the tube stack as shown in the FIG. 8. The baffle system 240 is disposed in such a manner that the baffles 302 are perpendicular to the flow of the hot gases, while the rods are parallel to the flow direction of the hot gases. From the FIG. 8, it can be seen that when the hot gases travel through the passage 239, the baffle system is contacted by the gases and is deflected by the baffles 302 into the tube stack that lies above the baffle system 240. In addition, the FIG. 8 shows that the hot gases rising from the lower tube stack 210($n$) rises through the baffle system 240 into the upper tube stack 210($n$+1). This uniform distribution of the hot gases through the tube stack improves the efficiency of the once-through evaporator. The baffles 302 may also be inclined to redirect the hot gases from the upper tube stack into the lower tube stack. The baffle system 240 does not only have to be placed between two tube stacks, but can also be disposed between a tube stack and a duct wall.

It is to be noted that this application is being co-filed with Patent Applications having Serial Nos. 13/744,094, 61/587,230, 13/744,104, 13/744,112, 13/744,121, 13/744,126, and 61/587,402, the entire contents of which are all incorporated by reference herein.

Maximum Continuous Load" denotes the rated full load conditions of the power plant.

"Once-through evaporator section" of the boiler used to convert water to steam at various percentages of maximum continuous load (MCR).

"Approximately Horizontal Tube" is a tube horizontally orientated in nature. An "Inclined Tube" is a tube in neither a horizontal position or in a vertical position, but disposed at an angle therebetween relative to the inlet header and the outlet header as shown.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, singular forms like "a," or "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The term and/or is used herein to mean both "and" as well as "or". For example, "A and/or B" is construed to mean A, B or A and B.

The transition term "comprising" is inclusive of the transition terms "consisting essentially of" and "consisting of" and can be interchanged for "comprising".

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A once-through evaporator comprising:

an inlet manifold;

one or more inlet headers in fluid communication with the inlet manifold;

a plurality of tube stacks, where each tube stack of the plurality of tube stacks comprises one or more inclined evaporator tubes;

the plurality of tube stacks being in fluid communication with the one or more inlet headers; where the inclined tubes are inclined at an angle of less than 90 degrees or greater than 90 degrees to a vertical, the vertical bein orthogonal to a direction of gas flow into the plurality of tube stacks;

one or more outlet headers in fluid communication with the plurality of tube stacks;

an outlet manifold in fluid communication with the one or more outlet headers; and a baffle system comprising a plurality of baffles, the baffle system being disposed in a passage between adjacent first and second tube stacks of the plurality of tube stacks, a portion of the baffles being angularly movable relative to the first and second tube stacks for adjusting a distribution of the gas flow through the tube stacks, the baffles being configured to selectively direct gas flow in the passage towards one or the other of the first and second tube stacks.

2. The once-through evaporator of claim 1, where the baffle system comprises a plurality of rods that are disposed atop and under a plurality of baffles.

3. The once-through evaporator of claim 2, where an angle between the rods and the baffles can be varied by varying a position of the rods.

4. The once-through evaporator of claim 1, where the baffle system contacts a tube of a tube stack above the baffle system and a tube of a tube stack below the baffle system; and where the respective contact occurs via a clip or a u-bolt.

5. The once-through evaporator of claim 4, where an angle between the rods and the baffles is fixed.

6. The once-through evaporator of claim 1, where the baffle system comprises three or more baffles.

7. The once-through evaporator of claim 1, where the baffle system comprises five or more baffles.

8. The once-through evaporator of claim 1, where the baffle system comprises parallel plates that serve as baffles.

9. The once-through evaporator of claim 1, where the baffle system is affixed to the once-through evaporator system between a pair of metal plates that support the tubes of the tube stack.

10. The once-through evaporator of claim 9, where the once-through evaporator system comprises a number of baffle systems that is less than or equal to a number of metal plates present in the once-through evaporator system.

11. The once-through evaporator of claim 9, where the once-through evaporator system comprises a number of baffle systems that is always one less than a number of metal plates present in the once-through evaporator system.

12. The once-through evaporator of claim 9, where the baffle system redirects hot gases through a tube section located above it, below it or to tube sections located above and below it.

* * * * *